United States Patent [19]

Freerking

[11] 4,106,676

[45] Aug. 15, 1978

[54] SEWING ACCESSORY

[76] Inventor: Judy Freerking, 1406 59th St., Kenosha, Wis. 53140

[21] Appl. No.: 815,570

[22] Filed: Jul. 14, 1977

[51] Int. Cl.[2] ..... A41H 31/00

[52] U.S. Cl. ..... 223/106; 211/44; 211/164

[58] Field of Search ..... 223/106, 107, 109, 108; 211/44, 56, 58, 163, 164; 242/55.3

[56] References Cited

U.S. PATENT DOCUMENTS

| | | | |
|---|---|---|---|
| 503,488 | 8/1893 | Marten | 211/44 |
| 893,983 | 7/1908 | Chilstrom | 211/44 X |
| 1,289,448 | 12/1918 | Herbert | 223/106 |
| 2,804,307 | 8/1957 | Rockola | 211/164 X |
| 2,962,156 | 11/1960 | Adams | 211/164 X |
| 3,119,394 | 1/1964 | Knittel | 211/164 X |

FOREIGN PATENT DOCUMENTS

| | | | |
|---|---|---|---|
| 931,631 | 8/1955 | Fed. Rep. of Germany | 211/44 |

*Primary Examiner*—George H. Krizmanich
*Attorney, Agent, or Firm*—William C. Babcock

[57] ABSTRACT

A flat bobbin dispenser conformed in the shape of a spool having two circular edge disks mounted on a central cylinder, each edge disk including on the interior surface thereof radially aligned tapered grooves. These grooves extend towards the center cylinder and terminate thereat in enlarged circular recesses. The disks are aligned on the cylinder in matched radial position, the opposing grooves thus forming a receiving slot for containing rectangular bobbins on which various threads are wound. Each bobbin furthermore includes edge cutouts to accommodate the thickness of the wound thread and one edge of each bobbin is enlarged to form a circular bead conformed for receipt in the opposed circular recesses. In this configuration the spool is supported on a pivotal mount to permit manual selection of the various threads by way of the angular rotation of the spool. To further enhance the usefulness of this device one end of the central cylinder is fitted with a hemispherical pin cushion while the other end is provided with a plurality of recesses for containing other sewing articles.

5 Claims, 7 Drawing Figures

SEWING ACCESSORY

BACKGROUND OF THE INVENTION

1. Field of the Invention

The present invention relates to storage devices, and more particularly to a dispenser storing various spools of thread.

2. Description of the Prior Art

Typically a seamstress or a person engaged in the art of sewing accumulates in time various kinds of threads either distinctive by texture or color. As the proficiency and precision is perfected in this art the selection of threads quickly multiplies. The storage of this wide variety of accumulated threads soon becomes a cumbersome matter and various devices like sewing baskets have been developed in the past for this purpose. One disadvantage of a sewing basket is the lack of convenience it provides in displaying this wide selection. In order to obtain the best match-up it is often desirable to wind the thread on a flat rather than a round bobbin, this arrangement providing the most visibly acute display for comparison. Heretofore more threads have been wound on cylindrical spools with the attendant variation and shading as a result of incident light, thus making comparison somewhat more difficult in their stored form. The use of a flat bobbin avoids this exact problem and is furthermore compatible with the many attachments now available in sewing machines for thread rewinding.

SUMMARY OF THE INVENTION

Accordingly, it is the general purpose and object of the invention to provide a circular storage device adapted to receive a plurality of flat thread bobbins.

Other objects of the invention are to provide a storage device conformed in the manner of a circular spool which is adapted to receive a plurality of flat bobbins between the edges thereof.

Yet further objects of the invention are to provide a storage device useful in the art of sewing which furthermore incorporates various other sewing fixtures by virtue of the structure thereof.

Briefly these and other objects of the present invention are accomplished by providing a storage device generally conformed in the manner of a circular spool having two lateral disks mounted on a common central cylinder or tube, each disk including on the interiorly opposed surface thereof, a plurality of V-shaped radial grooves, the taper of the "V" reducing with the radius. The spacing of the grooves on either of the disks is conformed for opposed relationship, each groove furthermore terminating proximate the central cylinder in enlarged circular recess. In this form the opposed grooves are adapted to receive correspondingly dimensioned flat rectangular spools of thread, each such spool or bobbin including an interior edge conformed as a circular bead adapted for receipt within the aforementioned circular recesses. These flat spools are thus free to pivot about the interior beads within the confines of the tapered groove, allowing for partial exposure of either side thereof to facilitate comparison.

This storage assembly is in turn mounted for rotation on a support bracket, the ends of the central cylinder being furthermore fitted with a pin cushion and a thimble storage device respectively.

DESCRIPTION OF THE SPECIFIC EMBODIMENT

Figure 1:
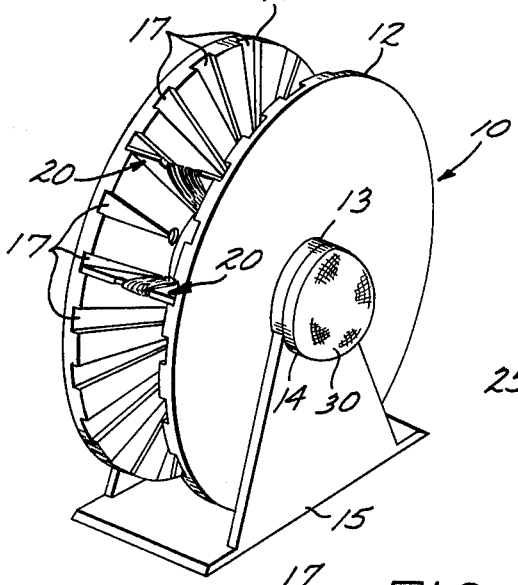
FIG. 1 is a perspective illustration of a thread storage device constructed according to the present invention.
Figure 4:
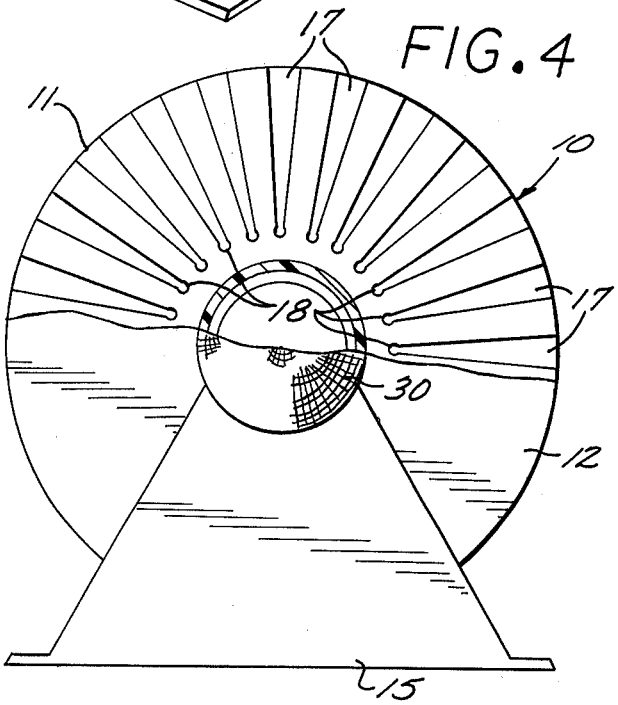
FIG. 4 is yet another side view illustrating in partial section, the detail of the storage device shown in FIG. 1.
Figure 5:
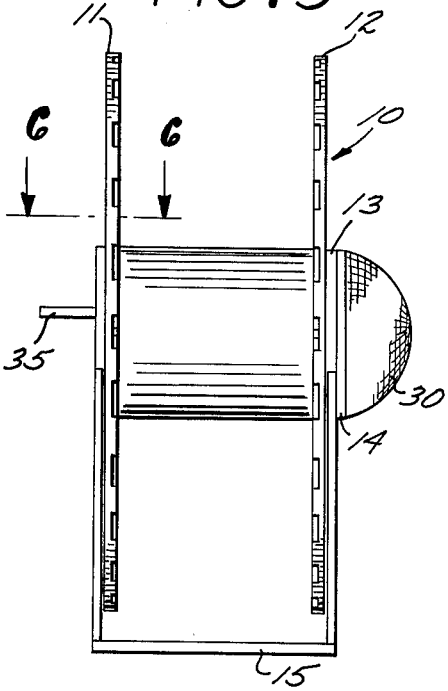
FIG. 5 is an end view of the storage device shown in FIG. 4.
Figure 6:
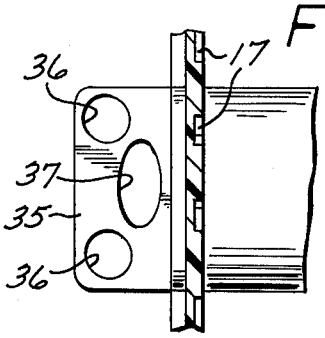
FIG. 6 is a sectional detail view illustrating one additional feature of the invention set out herein.

As shown in FIGS. 1 and 4 a storage device generally designated by the numeral 10 comprises two annular disks 11 and 12 respectively mounted proximate the distal ends of a common central cylinder 13. In this form cylinder 13 extends beyond the exterior surfaces of disks 11 and 12 to be supported in a semi-circular recess 14 formed in the ends of a support bracket 15. Thus, the combination of disks 11 and 12 and the cylinder 13 may be conveniently lifted off the stand 15 or alternatively may be rotated therein to any angular alignment.

Formed on the interior surface of disks 11 and 12, and aligned in substantially opposed radial alignment thereon, are a plurality of grooves 17, each tapered in planform towards the interior of the storage device and each terminating in a circular recess 18 proximate the cylinder 13. More specifically as shown in FIG. 4 the taper of each groove 17 is such that the end gap between the walls thereof is slightly smaller than the diameter of the circular recess 18. In this form the grooves 17 are adapted to receive a flat spool 20 such as that shown in FIG. 2, spool 20 being substantially rectangular in planform and having lateral dimensions correspondingly sized for receipt within the grooves.

Figure 2:
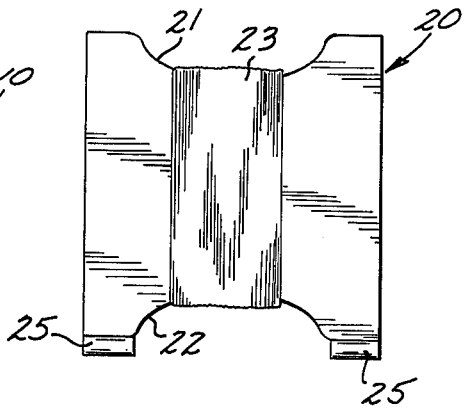
FIG. 2 is a plan view of a flat spool useful with the storage device shown in FIG. 1.
Figure 3:
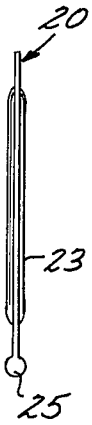
FIG. 3 is a side view of the spool shown in FIG. 2.
Figure 7:
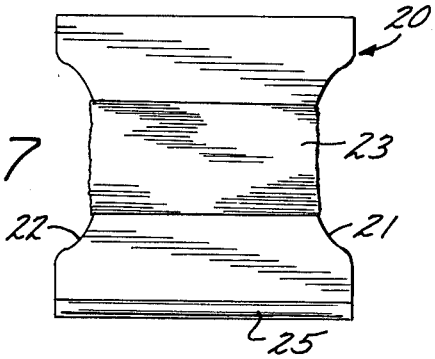
FIG. 7 is yet another plan view of a further embodiment of the flat spool useful herein.

As shown in particular in FIGS. 2 and 3, spool 20 includes two opposed edge cut outs 21 and 22, cut outs 21 and 22 providing the necessary clearance to accommodate the winding of thread 23 thereabout. In the configuration shown in FIGS. 2 and 3 the disposition of thread 23 is substantially radial relative to the radius of the storage device 10. Accordingly, one transverse edge of the rectangular spool 20 includes a circular enlargement or bead 25, bead 25 in this illustration being interrupted by the aforementioned cut out 22, thus forming two segments. In an alternative configuration, as shown in FIG. 7, the disposition of thread 23 may be transverse or between the slots 17. Bead 25 in this configuration being continuous and the cutouts 21 and 22 being formed in the lateral edges of the spool.

In either instance the insertion of spool 20 into the interior of the opposed grooves 17 requires an interference transition in order to insert the enlarged bead 25 into the circular recesses 18. Thus, regardless of the radial orientation, each spool 20 will be retained between the two disks 11 and 12, the tapered planform of the grooves 17 allowing for angular displacement thereof for inspection and furthermore facilitating the insertion sequence.

The foregoing features are further enhanced by the provision of a hemispherical pin cushion 30 attached to one free end of cylinder 13 and a flat plate 35 extending from the other end of the same cylinder. Plate 35 may include a plurality of circular openings 36 and other openings 37 conformed to receive various articles used in the art of sewing, while at the same time facilitates manipulation of the cylinder.

Thus the storage device 10 provides many of the functions heretofore achieved by way of large and cumbersome sewing baskets, the features being further integrated in order to provide convenient access and convenient means for selection and matching of the texture and color of thread.

Obviously many modifications and variations to the above disclosure can be made without departing from the spirit of the invention. It is therefore intended that the scope of the invention be determined solely dependent on the claims appended hereto.

What is claimed is:

1. A thread storage device comprising:

a cylindrical central mount;

a first and second annular disk disposed in axial alignment about said cylindrical mount in spaced relationship proximate the ends thereof, each said annular disk including a plurality of radial slots arranged in opposingly adjacent alignment, said slots being tapered in planform towards the interior of said disks, and a corresponding plurality of circular recesses formed at the interior ends of said slots; and a plurality of substantially rectangular planar bobbins received between the opposing ones of said slots each including a bead on one transverse edge thereof inserted in said recesses.

2. Apparatus according to claim 1 wherein:

said slots are formed in communicating relationship with the corresponding ones of said recesses, the communicating dimensions being smaller than the diameters of said recesses.

3. Apparatus according to claim 2 further comprising:

a retaining fixture formed as a bracket having a planar base surface joined to two parallel supports, said supports being dimensioned to receive said disks therebetween and conformed to engage the ends of said cylindrical mount.

4. Apparatus according to claim 3 wherein:

said cylindrical mount includes a hemispherical pin cushion attached to one end thereof and a plate extending from the other end thereof.

5. Apparatus according to claim 1 wherein:

said planar bobbins include cutouts in selected opposing edges thereof.

* * * * *